United States Patent [19]

Moura et al.

[11] Patent Number: 4,565,988

[45] Date of Patent: Jan. 21, 1986

[54] ELECTRIC COIL WITH SECURED CORES

[75] Inventors: Marc Moura, Pavillons sous Bois, France; Johannes H. Tobben, Breugel, Netherlands; Ernst Schmotz, Willing, Fed. Rep. of Germany

[73] Assignees: Siemens Aktiengesellschaft, Munich, Fed. Rep. of Germany; Thomson-CSF, Paris; L.C.C.-C.I.C.E., Bagnolet, both of France; U.S. Philips Corp., Tarrytown, N.Y.

[21] Appl. No.: 685,978

[22] Filed: Dec. 28, 1984

Related U.S. Application Data

[63] Continuation of Ser. No. 534,588, Sep. 22, 1983, abandoned.

[30] Foreign Application Priority Data

Sep. 27, 1982 [DE] Fed. Rep. of Germany ..... 3235655

[51] Int. Cl.[4] ..... H01F 27/26

[52] U.S. Cl. ..... 336/192; 336/198; 336/210

[58] Field of Search ..... 336/198, 65, 208, 210, 336/83; 310/218

[56] References Cited

U.S. PATENT DOCUMENTS 3,471,815 10/1969 Grant et al. ..... 336/83
4,075,590 2/1978 Foldes ..... 336/198 X

OTHER PUBLICATIONS

IBM Technical Disclosure Bulletin, "High Voltage Shield," Chacon et al, vol. 23, No. 1, Jun. 1980, 336–210, p. 65.

*Primary Examiner*—Thomas J. Kozma
*Attorney, Agent, or Firm*—Herbert L. Lerner; Laurence A. Greenberg

[57] ABSTRACT

Electric coil including a coil form having means at respective ends thereof for carrying respective soldering lugs, respective magnetizable cores disposed on the coil form at the respective ends thereof, and springs formed with angled-off ends, the springs respectively engaging the magnetizable cores at the respective ends of the coil form, the carrying means and said angled-off ends of the springs, respectively, being formed with respective laterally extending projections and recesses snappable over the projections so as to urge the cores towards one another.

2 Claims, 1 Drawing Figure

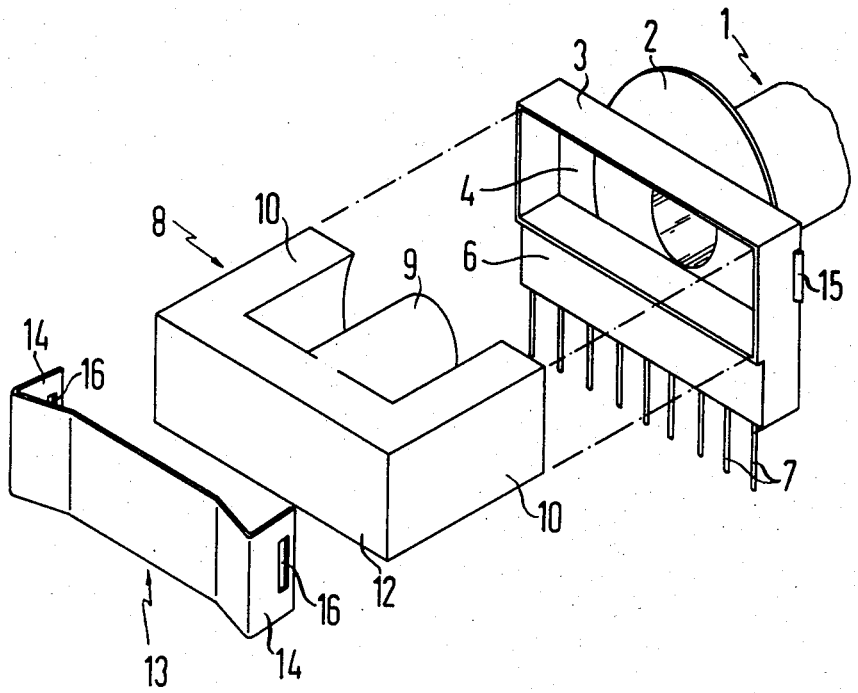
1
2
3
4
6
7
8
9
10
10
12
13
14
14
15
16
16

ELECTRIC COIL WITH SECURED CORES

This application is a continuation of application Ser. No. 534,588, filed Sept. 22, 1983, now abandoned.

The invention relates to an electric coil and, more particularly, to an electric coil suitable for use in printed circuit boards, the electric coil having a coil form with at least one coil-form flange with soldering lugs and with magnetizable cores, such as ferrite cores especially, slipped or stuck onto the coil form.

It is an object of the invention to provide an electric coil of the foregoing general type with a simple mounting which is assemblable without effort, desirably or necessarily also automatically, and which ensures exact alignment of the cores relative to one another and to the coil form, the mounting effecting in the case of E-cores, for example, an exertion of pressure virtually only on the mutually abutting outer legs of the E-cores, and thereby largely avoiding an undesired air gap between the end faces of the outer legs which face one another.

With the foregoing and other objects in view, there is provided, in accordance with the invention, an electric coil comprising a coil form having means at respective ends thereof for carrying respective soldering lugs, respective magnetizable cores disposed on the coil form at the respective ends thereof, and springs formed with angled-off ends, the springs respectively engaging the magnetizable cores at the respective ends of the coil form, the carrying means and the angled-off ends of the springs, respectively, being formed with respective laterally extending projections and recesses snappable over the projections so as to urge the cores towards one another.

Optionally, the coil form flanges can be provided with projections and the springs with cutouts or vice versa. The arrangement of the projections or, if this is advantageous, the cutouts of the coil form flanges which ar at least approximately parallel to the angled-off ends of the leaf springs. Assuming that there are no such inclined surfaces, integral forming-on of projections at the coil form flanges is advisable, which lie in a common plane with the coil form flanges.

Other features which are considered as characteristic for the invention are set forth in the appended claims.

Although the invention is illustrated and described herein as emnbodied in electric coil, it is nevertheless not intended to be limited to the details shown, since various modifications and structural changes may be made therein without departing from the spirit of the invention and within the scope and change of equivalents of the claims.

The construction and method of operation of the invention, however, together with additional objects and advantages thereof will be best understood from the following description of specific embodiments when read in connection with the accompanying drawing of the single FIGURE of the drawing which is an exploded front, top and side view of one-half of an electric coil partly broken away, the winding of the electric coil having been omitted in the interest of clarity. Referring now to the FIGURE of the drawing, there is shown therein a coil form 1 having coil form flanges 2, only one of which is shown on the FIGURE, integrally formed at end faces of a cylindrical body whereon a non-illustrated coil is wound, each of the coil-form flanges 2 being provided with a solder lug strip 6 to which there is added a rectangular frame 3, the strip 6 being equipped with electric connector pins 7. In the illustrated embodiment, outwardly directed projections 15 are integrally formed-on on the narrow sides of the frame 3.

In the assembled condition of the electric coils, the middle core leg 9 of the respective E-core halves 8 formed of ferrite, only one of which is illustrated in the FIGURE, extend into the hollow cylindrical interior of the winding body of the coil form 1, and the outer legs 10 of the respective E-core half 8 penetrates recesses 4 formed in the frame 3. Leaf springs 13, only one of which is shown, preferably engage only regions of surfaces 12 of the halves 8 of the E-core which are located adjacent the respective outer legs 10 thereof, so that only the outer legs 10 of the respective E-core halves 8 are urged towards one another. Recesses 16 formed in angled-off ends 14 of the leaf spring 13 snap over the projections 15 extending from the frame 3 and thus assure a secure retention of the leaf spring 13 and consequently also a reliably positioned arrangement of the respective E-core halves 8.

Should there be no frame 3, the projections 15 may also be formed integrally onto the end face edges of the end flanges 2 which may be rectangular, if desirable or necessary.

The foregoing is a description corresponding, in substance, to German application No. P 32 35 655.2, dated Sept. 27, 1982, international priority of which is being claimed for the instant application, and which is hereby made part of this application. Any material discrepancies between the foregoing specification and the specification of the aforementioned corresponding German application are to be resolved in favor of the latter.

There are claimed:

1. Electric coil comprising a winding on a coil form, said coil form having a longitudinal axis and coil form flanges located at respective ends thereof, each of said coil form flanges carrying a plurality of soldering lugs extending parallel to one another and perpendicularly to the longitudinal axis of said coil form, respective magnetizable cores disposed on said coil form at said respective ends thereof, and springs having a substantially planar middle portion and formed with end portions bent out of the plane of said middle portion, said springs respectively engaging said magnetizable cores at said respective ends of the coil form, said coil form flange and said bent end portions of said springs, respectively, being formed with respective laterally extending projections and recesses snappable over said projections so as to urge said cores towards one another in longitudinal direction of said coil form.

2. Electric coil according to claim 1 including a substantially rectangular frame integral with said coil form flange and carrying said projections, said spring ends being formed with said recesses.

* * * * *